US007973675B2

(12) United States Patent
Glatfelter

(10) Patent No.: US 7,973,675 B2
(45) Date of Patent: Jul. 5, 2011

(54) GOAL-DRIVEN INFERENCE ENGINE FOR TRAFFIC INTERSECTION MANAGEMENT

(75) Inventor: John W. Glatfelter, West Chester, PA (US)

(73) Assignee: The Boeing Company, Chicago, IL (US)

( * ) Notice: Subject to any disclaimer, the term of this patent is extended or adjusted under 35 U.S.C. 154(b) by 419 days.

(21) Appl. No.: 12/103,598

(22) Filed: Apr. 15, 2008

(65) Prior Publication Data

US 2009/0256721 A1 Oct. 15, 2009

(51) Int. Cl.
*G08G 1/095* (2006.01)

(52) U.S. Cl. ..... 340/907; 340/941; 340/908.1

(58) Field of Classification Search ..... 340/907, 340/933, 941, 910, 917, 935, 944, 925, 908.1, 340/909, 911, 931–932, 905
See application file for complete search history.

(56) References Cited

U.S. PATENT DOCUMENTS 5,801,646 A * 9/1998 Pena ..... 340/902
5,880,682 A * 3/1999 Soulliard et al. ..... 340/907
6,597,293 B1 * 7/2003 Harrison ..... 340/944
6,617,981 B2 * 9/2003 Basinger ..... 340/909
6,633,238 B2 * 10/2003 Lemelson et al. ..... 340/909
7,610,151 B2 * 10/2009 Letchner et al. ..... 701/209
2005/0156757 A1 * 7/2005 Garner ..... 340/907
2008/0252485 A1 * 10/2008 Lagassey ..... 340/907

OTHER PUBLICATIONS

Yu, et al., "Fiber Optic Implementation of a Cumulative Momentum Model for Natural Urban Intersection Traffic Management", Proceedins of the 2003 Mid-Continent Transportation Research Symposium, Iowa State University, Aug. 2003, pp. 1-12.

* cited by examiner

*Primary Examiner* — Daniel Previl
(74) *Attorney, Agent, or Firm* — Caven & Aghevli LLC

(57) ABSTRACT

A system includes a plurality of sensors that provide information regarding instantaneous traffic conditions incident to an intersection. An inference engine of the system receives the sensor information and processes user-defined traffic control algorithms and weighted management parameters. Control signals are derived in accordance with the processing. Multi-state signaling devices are driven in accordance with the control signals so as to manage vehicular and pedestrian traffic flow at the intersection. Playback of historic traffic information permits analysis and verification of the traffic management strategies implemented by the system.

20 Claims, 3 Drawing Sheets

GOAL-DRIVEN INFERENCE ENGINE FOR TRAFFIC INTERSECTION MANAGEMENT

FIELD OF THE DISCLOSURE

The field of the present disclosure relates to traffic control, and more specifically, to actuating traffic control signaling devices at a roadway intersection.

BACKGROUND OF THE DISCLOSURE

Surface vehicles often pass through numerous roadway intersections while traversing between their respective origins and destinations. Traffic control signaling devices in the form of green/yellow/red light assemblies are ubiquitous and usually operate under simple timer-based control strategies. Such signaling devices generally cycle repeatedly through the permitting of traffic flow along one roadway, then another, and so on, starting the whole process over again. This "mindless" time-based cycling does not, among other things, take into account actual instantaneous traffic density (i.e., vehicular mass flow) along one roadway with respect to any other. As a result, unnecessary time and energy resources are wasted while, very often, a majority of vehicles are forced to wait out a red light while fewer vehicles—or none at all—are permitted to proceed along another roadway. Therefore, improved traffic control signaling would have great utility.

SUMMARY

An intersection management system includes various sensors that provide signals corresponding to traffic conditions incident to a roadway intersection. An inference engine processes one or more traffic control algorithms, which may include respectively weighted parameters, according to the sensor signals. The inference engine then provides control signals for sequencing one or more traffic signaling devices in order to modulate vehicular and pedestrian traffic flow at the intersection. The traffic control algorithms are flexible and reflect user-defined goals. Playback of historic traffic patterns permits analysis, verification and/or modification of the user's traffic control stratagems. Users of the present teachings may include municipalities, local and/or state traffic management personnel, and others.

In one implementation, a system includes one or more sensors configured to detect one or more characteristics of traffic incident to a roadway intersection. The sensors are also configured to provide corresponding signals. The system also includes a memory configured to store traffic information according to the signals provided by the sensors. The system further includes a knowledge base, which includes one or more traffic control algorithms defined by a user. The system includes an inference engine configured to derive one or more control signals. The inference engines uses the traffic information stored in the memory and the traffic control algorithms stored in the knowledge base. The system also includes a signal driver configured to actuate at least one multi-state traffic control signaling device according to the control signals.

In another implementation, an apparatus includes an inference engine that is configured to receive sensor information corresponding to traffic incident to a roadway intersection. The inference engine is also configured to access one or more traffic control algorithms defined by a user. The inference engine is further configured to provide one or more control signals derived using the traffic control algorithms and the sensor information.

In yet another implementation, a method includes receiving sensor signals corresponding to traffic incident to a roadway intersection. The method also includes deriving at least one control signal using one or more traffic control algorithms and the sensor signals. The method further includes actuating at least one multi-state traffic signaling device using the at least one control signal.

The features, functions, and advantages that are discussed herein can be achieved independently in various embodiments of the present disclosure or may be combined with various other embodiments, the further details of which can be seen with reference to the following description and drawings.

BRIEF DESCRIPTION OF THE DRAWINGS

Embodiments of systems and methods in accordance with the teachings of the present disclosure are described in detail below with reference to the following drawings.

DETAILED DESCRIPTION

The present disclosure introduces systems and methods for implementing flexible, verifiable and user-defined traffic control at a roadway intersection. Many specific details of certain embodiments of the disclosure are set forth in the following description and in FIGS. 1-4 to provide a thorough understanding of such embodiments. One skilled in the art, however, will understand that the disclosure may have additional embodiments, or that the disclosure may be implemented without several of the details described in the following description.

Illustrative Operating Environment

Figure 1:
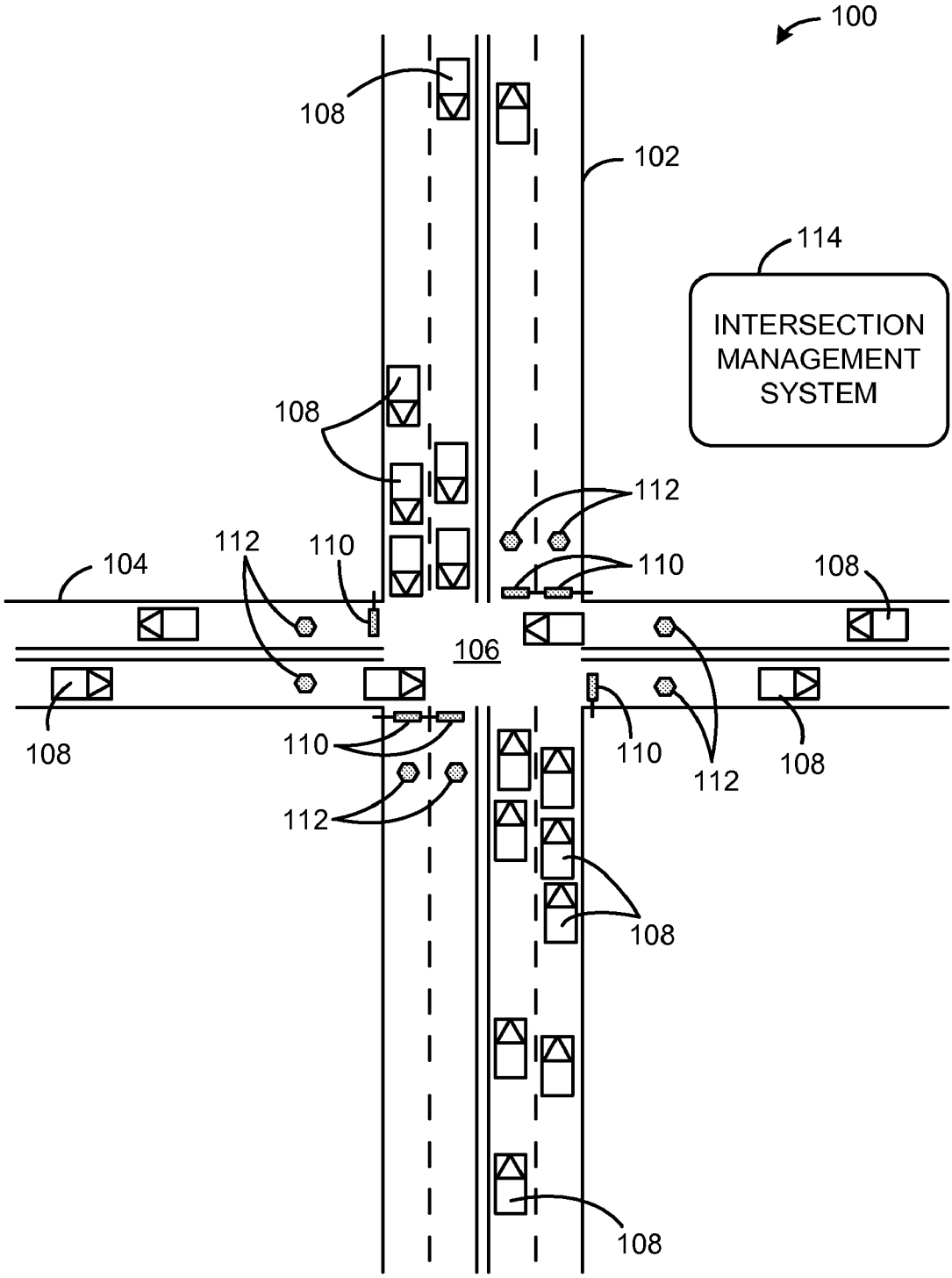
FIG. 1 is a diagrammatic plan view of an intersection under control according to one operating environment.

FIG. 1 is a diagrammatic plan view of a controlled intersection (intersection) 100. The intersection 100 is illustrative and non-limiting with respect to the present teachings. The intersection 100 includes a first roadway 102 and a second roadway 104. The first and second roadways 102 and 104 are substantially orthogonal to each other, crossing at a roadway intersection 106. Each of the roadways 102 and 104 support bidirectional travel of various types of vehicles 108. Such vehicles 108 may include passenger automobiles, pickup trucks, motorcycles, bicycles, commercial delivery vans or semi-trucks, emergency response vehicles, public transit vans or busses, etc. Other types of road vehicles can also travel along the first and second roadways 102 and 104, respectively.

The intersection 100 includes a plurality of traffic control signaling devices (devices) 110. Each of the devices 110 is understood to be defined by a multi-state, green/yellow/red light signaling device as is commonly known and used. Other kinds of devices 110 may also be implemented. In any case, each device 110 provides a colored illumination signal indicating permission for traffic to proceed (i.e., green) through the intersection 106 in a particular direction, indicating the exercise of caution (i.e., yellow), and indicating that traffic in a certain direction is to stop (i.e., red). Each of the traffic control signaling devices 110 is coupled to an intersection management system (system) 114 that will be described in detail hereinafter.

The intersection 100 also includes a plurality of sensors 112. As depicted, the sensors 112 are understood to be configured to detect vehicles 108 within a given lane of a respective roadway 102 or 104. In one non-limiting implementation, one or more of the sensors 112 are configured to provide respective signals corresponding to the mass of respective vehicles 108 passing over or in near proximity thereto. In another implementation, one or more of the sensors 112 are configured to provide respective signals corresponding to the velocity of respective vehicles 108 passing over or in near proximity thereto. Other kinds of sensors (not shown) may also be used including, as non-limiting examples, user-input devices signaling a pedestrian request to cross a street (i.e., 102 or 104), sensors indicating the presence of a vehicle or vehicles in a standing (i.e., waiting) condition, etc. The sensors 112, regardless of their respective detection and signaling configurations, provide information corresponding to one or more characteristics of traffic (vehicular, pedestrian, etc.) approaching, proximate to, and/or passing through the intersection area 106. Such traffic in its various types and states is considered "incident to" the roadway intersection 106 for purposes herein. Each of the sensors 112 (and/or others not shown) are coupled to provide their respective signals to the system 114.

The intersection 100 further includes the intersection management system 114 as introduced above. The system 114 is configured to receive signals from the sensors 112 (and/or others) and to derive (i.e., calculate, or generate) one or more control signals used to drive the signaling devices 110. The system 114 can implement any number of traffic control strategies in accordance with user-defined algorithms. Furthermore, the system 114 is configured to store and playback (i.e., display or present) historical traffic flow data for the roadway intersection 106 for later analysis. Illustrative operations of the system 114 are described hereinafter. While the intersection 100 is depicted in the context of two roadways crossing each other at right-angles, it is to be understood that the present teachings may be applied where two or more roadways join, cross and/or merge, in essentially any configuration, and wherein traffic control signaling is applied for safe vehicle operation.

Illustrative Management System

Figure 2:
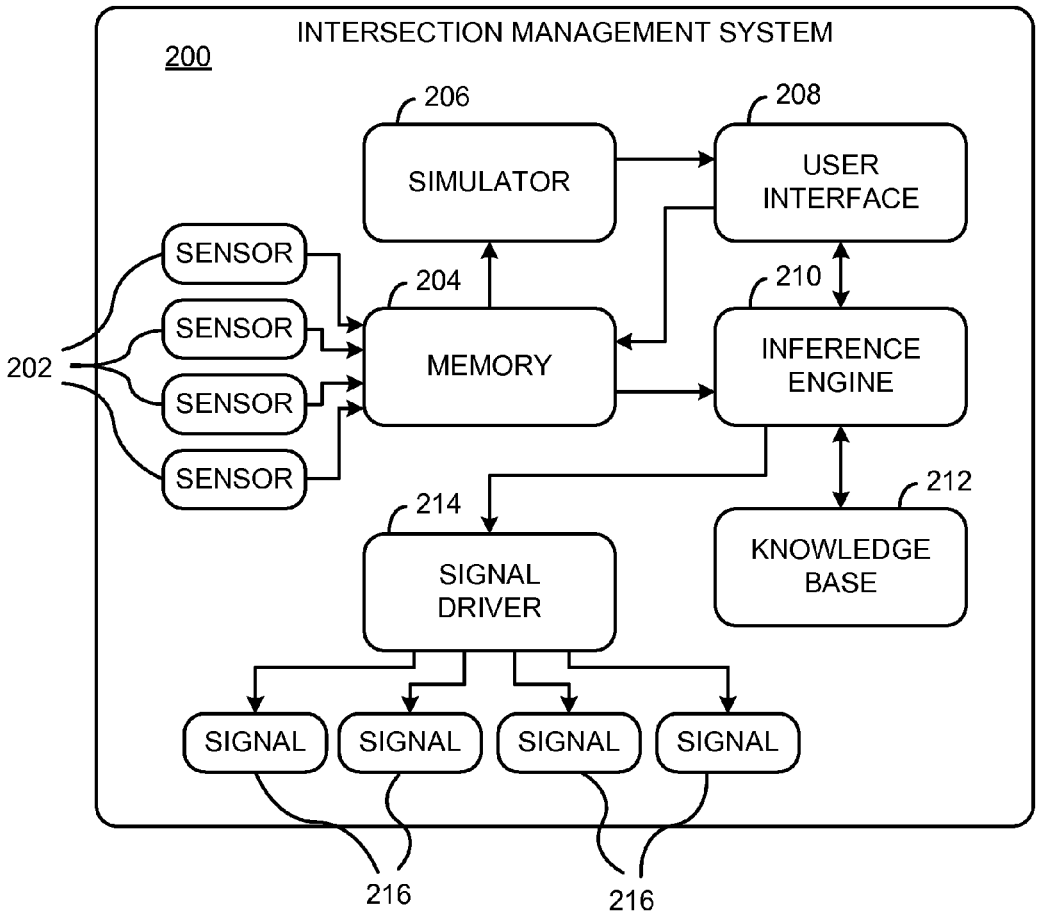
FIG. 2 is a block diagrammatic view depicting an illustrative intersection management system according to one implementation.

FIG. 2 is a block diagrammatic view depicting an intersection management system (system) 200 according to an illustrative and non-limiting implementation of the present teachings. The system 200 may define, for example, the system 114 of FIG. 1. The system 200 includes a plurality of sensors 202. The sensors 202 are configured to provide respective signals corresponding to traffic incident to a roadway intersection being controlled by the system 200. As such, the sensors 202 can include vehicle mass detection, vehicle velocity detection, pedestrian crossing requests, standing vehicle detection, etc. Sensors 202 may include, in addition to other types, electromagnetic or fiber-optic devices, etc. Other sensors 202 providing signals indicative of various traffic characteristics may also be used. Additionally, sensors 202 (or others) may be placed anywhere as needed.

The system 200 includes a memory 204. The memory 204 can be defined by any suitable data (i.e., information) storage apparatus. Non-limiting examples of such memory 204 include random access memory (RAM), non-volatile storage memory, an optical data storage device, a magnetic storage device (disk drive), electrically erasable programmable read only memory (EEPROM), etc. Other types of memory 204 may also be used. In any case, the memory 204 is configured to retrievably store data and information corresponding to present and historical traffic conditions at a roadway intersection. The memory 204 is configured to receive signals from the sensors 202 and to store corresponding traffic information. The memory 204 may also includes (store) default settings or basic control information for the system 200 in the event of a long-term power loss or other disabling event.

The system 200 includes a simulator 206. The simulator 206 is configured to selectively retrieve traffic information (i.e., historical data) from the memory 204 and to present that information to a user by way of a user interface 208. Such presentation, or playback, may be performed in any suitable graphic and/or textual format. The simulator 206 permits a user to review traffic patterns at an intersection and analyze the relative efficacy of the control algorithm(s) implemented by the system 200. In one implementation, the simulator 206 is configured to transmit user-requested traffic information to a remote receiving station for review and analysis.

The system 200 further includes a user interface 208. The user interface 208 may include any suitable devices and apparatus such as, for non-limiting example, pushbuttons, an electronic display, a hardcopy printer, indicating lights, a voice operated interface, etc. Other user interface resources may also be used. The user interface 208 is configured to interrogate the memory 204 by way of the simulator 206, to manage and/or change control algorithms of the system 200, and to facilitate any other suitable or desirable user interactions with the system 200. Further details regarding the user interface 208 are included hereinafter.

The system 200 also includes an inference engine 210. The inference engine 210 is configured to communicate with, and be responsive to, the user interface 208. The inference engine 210 is also configured to receive traffic information data from the memory 204 and to retrieve one or more traffic control algorithms (i.e., user-defined programming) from a knowledge base 212. The inference engine 210 is further configured to derive (i.e., generate and provide) one or more traffic control signals in accordance with the control algorithm(s) and the present traffic information. In this way, the inference engine 210 is a computational resource capable of calculating or processing algorithms in order to derive the one or more traffic control signals.

The system 200 also includes a knowledge base 212 as introduced above. The knowledge base 212 includes accessible storage for one or more traffic control algorithms, weighted traffic management parameters used in conjunction with one or more of the algorithms, and other information corresponding to a roadway intersection under the control of the system 200. Thus, the knowledge base 212 can be defined by suitable storage such as, for non-limiting example, random access memory (RAM), non-volatile storage memory, an optical data storage device, a magnetic storage device (disk drive), electrically erasable programmable read only memory (EEPROM), etc. Other types of storage may be used for the knowledge base 212. The knowledge base may further include other relevant information such as geometry of the roadway intersection or other factors used in processing the user-defined control algorithms.

The system 200 further includes a signal driver 214. The signal driver 214 is configured to receive the one or more control signals provided by the inference engine 210 and to provide corresponding drive signals (i.e., electrical energy) to one or more signaling devices (i.e., traffic lights) 216. The signal driver 214 thus performs power switching and/or electrical signal de-multiplexing according to the control signals from the inference engine 210, so as to appropriately sequence the signaling devices 216. In turn, each of signaling devices 216 is defined by a multi-state (i.e., green/yellow/red) traffic light device.

The system 200 is illustrative and non-limiting with respect to the present teachings. For example, while a total of four sensors 202 are depicted, it is to be understood that any suitable number of sensors 202 may be coupled and used with the system 200. Similarly, the number of signaling devices 216 need not be four as shown, but can be any suitable number of such devices 216 as required to serve a particular roadway intersection (e.g., 106). The system 200 is configured to provide for flexible implementation of traffic control stratagems by way of the algorithm or algorithms applied by the inference engine 210. For example, and not by limitation, the inference engine 210 can apply respective goal-oriented algorithms that:

- estimate vehicle size and mass based on sensor data, by way of axle counting, axle spacing, etc;
- employ interrupts associated with pedestrian requests to cross a roadway;
- employ interrupts associated with emergency vehicle or public transit priority passage through an intersection;
- distinguish control priorities based upon peak versus off-peak traffic periods, weekday versus weekend periods, holidays, etc;
- preserve the collective momentum of the vehicle traffic through an intersection;
- employ user-defined signaling light timing sequences;
- preserve the collective kinetic energy of the vehicle traffic through an intersection; and/or
- maximize or optimize the number of vehicles through an intersection per unit time.
- Other algorithms or goal-oriented control strategies can also be used. It is to be understood that the system 200 is directed to implementation of essentially limitless traffic control methodologies, predominantly directed to traffic flow optimization, while providing the ability to recall and analyze actual, historic traffic pattern data for purposes of verification and/or improvement of the control strategies.

First Illustrative Method

Figure 3:
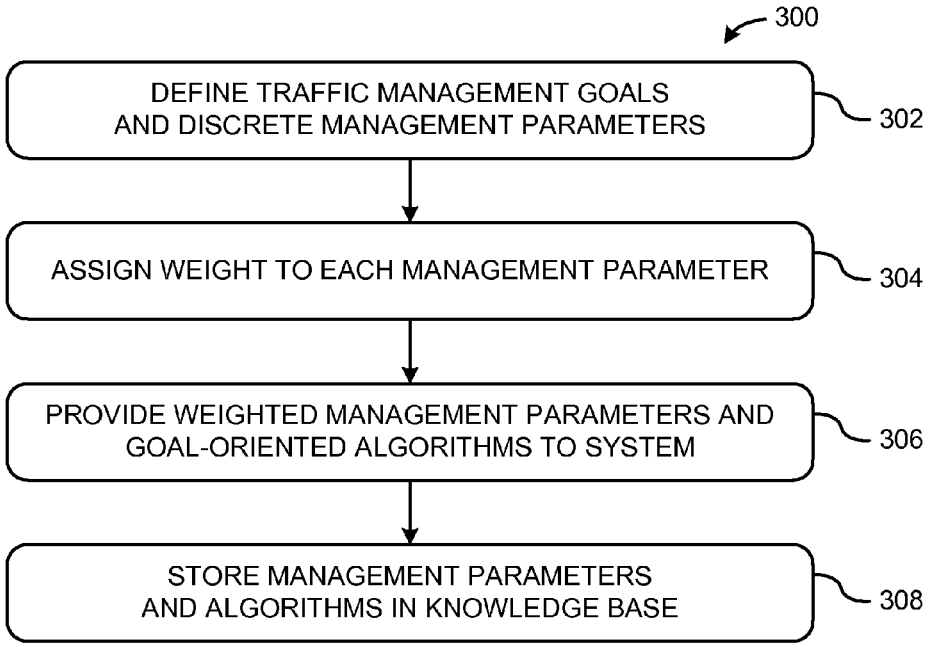
FIG. 3 is a flow diagram depicting a method in accordance with one implementation.

FIG. 3 is a flow diagram 300 depicting a method in accordance with one implementation of the present teachings. The diagram 300 depicts particular method steps and order of execution. However, it is to be understood that other implementations can be used including other steps, omitting one or more depicted steps, and/or progressing in other orders of execution without departing from the scope of the present teachings.

At 302, a user defines traffic management goals and respective, discrete traffic management parameters. As an illustrative and non-limiting example, a user defines two distinct traffic management goals for operating an intersection: 1) priority of passage is given to that roadway having the greatest collective traffic mass within a certain approach distance to the intersection; and 2) stopped traffic wait time should not exceed one-hundred seconds divided by the number of vehicles waiting to proceed. Other traffic management parameters may also be defined and used.

At 304, a user assigns weight to each of the management parameters defined at 302 above. For purposes of ongoing example, a user assigns a weight of 0.60 to parameter 1) as defined above, and a weight of 0.40 to the parameter 2) as defined above. Thus, under this example, the greater weight (i.e., priority) is placed on permitting that roadway with the greater traffic mass to pass through the intersection, until a calculated time threshold has elapsed for the waiting vehicles. In this way, the busier roadway is permitted priority of passage, yet no roadway is required to wait indefinitely if one or more vehicles are waiting to pass. In some implementations, the goal-oriented algorithms are such that equal weighting can be assigned to each of them.

At 306, the goal-oriented algorithms and weighted parameters are provided to an intersection management system (e.g., 200) by way of a user interface (e.g., 208) or other suitable means. The one or more algorithms are defined or coded in such a way as to be processed by the inference engine (e.g., 210) of the system.

At 308, the system stores the algorithms and weighted parameters are stored in a knowledge base (e.g., 212) of the system. Thus, the algorithms and weighted parameters are now accessible during normal operation of the intersection management system.

Second Illustrative Method

Figure 4:
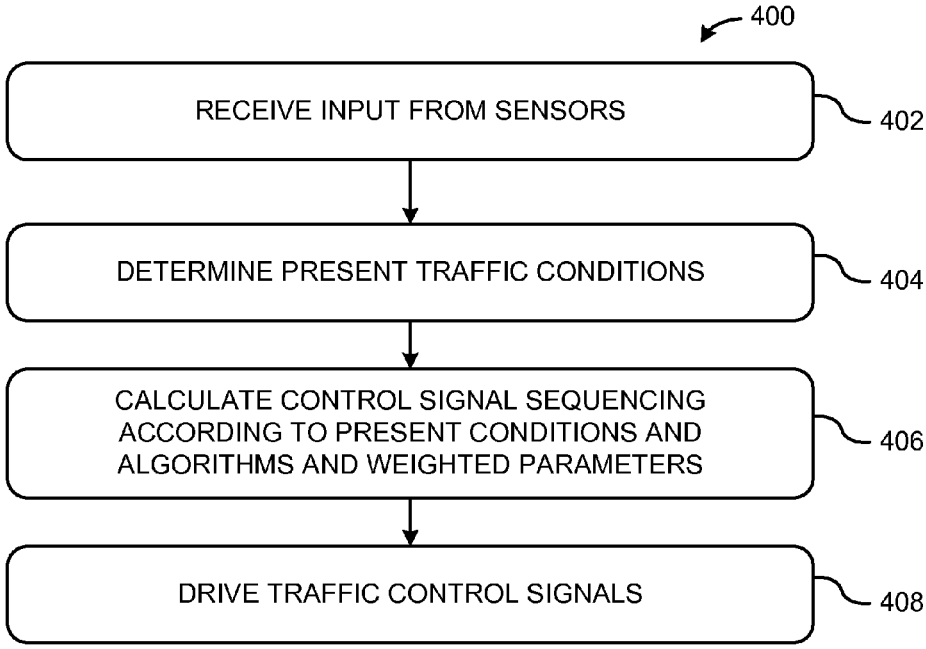
FIG. 4 is a flow diagram depicting a method in accordance with another implementation.

FIG. 4 is a flow diagram 400 depicting a method in accordance with another implementation of the present teachings. The diagram 400 depicts particular method steps and order of execution. However, it is to be understood that other implementations can be used including other steps, omitting one or more depicted steps, and/or progressing in other orders of execution without departing from the scope of the present teachings.

At 402, an intersection management system (e.g., 200) receives input from one or more sensors (e.g., 202) corresponding to traffic characteristics at a roadway intersection. Such sensor signals can include, without limitations, count of vehicles on approach to the intersection, vehicle mass measurements, velocities of vehicles on approach to the intersection, pedestrian requests to cross one or more roadways, etc. Other sensor signals may also be received.

At 404, the sensor signals are conditioned and/or interpreted, as needed, in order determine instantaneous traffic conditions incident to the intersection. For example, the signals may be processed so as to determine the traffic mass flow rate (e.g., kilograms of vehicles per second) along a roadway toward the intersection. In another example, the signals may be processed so as to determine the number of vehicles waiting to proceed along at a roadway through the intersection. Other determinations can also be made.

At 406, an inference engine (e.g., 210) of the intersection management system calculates a control signal sequence in accordance with the presently determined traffic conditions, user-defined algorithms, and user-defined weighted traffic management parameters. As such, the inference engine then generates one or more control signals in accordance with the signal sequencing calculations.

At 408, the control signals generated at 406 above are amplified and/or processed as needed so as to drive one or more multi-state traffic signaling devices (e.g., 216) at the intersection. Such multi-state signaling devices are typically defined by green/yellow/red signaling devices. Other types of signaling devices can be used. In any case, the instantaneous traffic conditions are reconciled with the control algorithms and weighted management goals, and the traffic signal devices actuated accordingly.

While specific embodiments of the disclosure have been illustrated and described herein, as noted above, many changes can be made without departing from the spirit and scope of the disclosure. Accordingly, the scope of the disclosure should not be limited by the disclosure of the specific embodiments set forth above. Instead, the scope of the disclosure should be determined entirely by reference to the claims that follow.

What is claimed is:

1. A system, comprising:

one or more sensors configured to detect one or more characteristics of traffic incident to a roadway intersection and to provide corresponding signals;

a memory configured to store traffic information according to the signals provided by the sensors;

a knowledge base including one or more traffic control algorithms defined by a user, each traffic control algorithm assigned a corresponding weighted traffic management parameter to prioritize the respective traffic control algorithm over another traffic control algorithm;

an inference engine configured to derive one or more control signals using the traffic information stored in the memory and the traffic control algorithms stored in the knowledge base that are prioritized using the weighted traffic management parameters; and a signal driver configured to actuate at least one multi-state traffic control signaling device according to the control signals.

2. The system of claim 1, further comprising:

a user interface; and a simulator configured to retrieve traffic information from the memory and to display historical traffic flow patterns by way of the user interface.

3. The system of claim 1 wherein at least some of the traffic control algorithms are based at least in part on one or more of a cumulative momentum of vehicles moving in traffic incident to the roadway intersection and a cumulative mass of vehicles waiting to proceed through the roadway intersection.

4. The system of claim 1 wherein the signal driver actuates at least one multi-state green/yellow/red light signaling device according to the control signals.

5. The system of claim 1 wherein at least some of the traffic control algorithms give traffic flow preference to public transit or emergency vehicles.

6. The system of claim 1 wherein at least one of the sensors is configured to provide signals corresponding to:

a mass of a detected vehicle;

a velocity of a detected vehicle; or a pedestrian request to cross a roadway.

7. The system of claim 1, further comprising a user interface configured to facilitate user management of:

the one or more sensors;

the one or more traffic control algorithms within the knowledge base; and the weighted traffic management parameters within the knowledge base.

8. An apparatus comprising an inference engine configured to:

receive sensor information corresponding to traffic incident to a roadway intersection;

access two or more traffic control algorithms defined by a user;

access weighted traffic management parameters for each of the two or more traffic control algorithms, the weighted traffic management parameters to provide a relative priority of the traffic control algorithms; and provide one or more control signals to sequence a multi-state green/yellow/red traffic light device, the one or more control signals derived using the traffic control algorithms in combination with respective weighted traffic management parameters and the sensor information.

9. The apparatus of claim 8 wherein the sensor information indicates a mass of a detected vehicle.

10. The apparatus of claim 8 wherein the inference engine is further configured to communicate with a user interface.

11. The apparatus of claim 8 wherein the inference engine is further configured such that the one or more control signals are derived so as to optimize a mass flow rate of vehicular traffic through the roadway intersection.

12. The apparatus of claim 8 wherein the inference engine is further configured to retrievably store the weighted traffic management parameters within a knowledge base.

13. The apparatus of claim 8 wherein the inference engine is further configured to receive the traffic sensor information from a memory.

14. The method of claim 8, wherein the two or more traffic control algorithms are configured to accept weighted traffic management parameters that provide equal weight to at least two of the traffic control algorithms.

15. The method of claim 8, wherein weighted traffic management parameters provide equal weight to at least two of the traffic control algorithms.

16. A method, comprising:

receiving sensor signals corresponding to traffic incident to a roadway intersection;

receiving traffic control algorithms and corresponding weighted traffic management parameters to provide a relative priority of the traffic control algorithms;

deriving at least one control signal using the traffic control algorithms with the corresponding weighted traffic management parameters based at least in part on the sensor signals; and actuating at least one multi-state traffic signaling device using the at least one control signal.

17. The method of claim 16, further comprising receiving user input corresponding to a change in the traffic control algorithms.

18. The method of claim 16, further comprising storing traffic information corresponding to the sensor signals in a memory.

19. The method of claim 18, further comprising:

retrieving at least some of the traffic information from the memory; and displaying the traffic information to a user during a simulation by way of a user interface.

20. The method of claim 16 wherein the at least one control signal is derived so as to optimize a mass flow rate of vehicular traffic through the roadway intersection.

* * * * *